US007145087B1

(12) United States Patent
Su et al.

(10) Patent No.: US 7,145,087 B1
(45) Date of Patent: Dec. 5, 2006

(54) MULTI-INSTRUCTION SWITCH

(75) Inventors: Tsui-Jung Su, Taipei Hsien (TW); Yun-Chen Chen, Taipei Hsien (TW); Hong-Yi Lee, Taipei Hsien (TW)

(73) Assignee: Zippy Technology Corp., Hsin-Tien (TW)

( * ) Notice: Subject to any disclaimer, the term of this patent is extended or adjusted under 35 U.S.C. 154(b) by 70 days.

(21) Appl. No.: 11/212,740

(22) Filed: Aug. 29, 2005

(51) Int. Cl.
*H01H 9/00* (2006.01)

(52) U.S. Cl. ..... 200/4; 200/5 A; 200/11 R

(58) Field of Classification Search ..... 200/4, 200/5 A, 5 R, 6 R, 18, 565, 11 R, 11 TW, 200/17 R, 573
See application file for complete search history.

(56) References Cited

U.S. PATENT DOCUMENTS 4,000,382 A * 12/1976 Kolb ..... 200/4
4,394,546 A * 7/1983 Harumatsu ..... 200/5 R
5,668,359 A * 9/1997 Alvord et al. ..... 200/6 B
6,236,002 B1 * 5/2001 Chou ..... 200/4
6,262,378 B1 7/2001 Chou
6,344,619 B1 * 2/2002 Yamasaki et al. ..... 200/6 A
6,388,212 B1 * 5/2002 Ishihara et al. ..... 200/18

* cited by examiner

*Primary Examiner*—Richard K. Lee
(74) *Attorney, Agent, or Firm*—Birch, Stewart, Kolasch & Birch, LLP

(57) ABSTRACT

A multi-instruction switch includes a control disk, an anchor member and a depressing element. The control disk can drive a first conductive element to rotate relative to the anchor member. The anchor member has a terminal connector which includes a common terminal, a first terminal, at least one second terminal and a third terminal. A second conductive element located beneath the depressing element can move up and down relative to the depressing element to connect a circuit. The first conductive element has a plurality of contact arms mating the terminal connector. One of the contact arms is connected to the common terminal in normal conditions. Other contact arms are connected alternately to contact zones and non-contact zones of the first and second terminals to generate a plurality of signals. By pressing the depressing element to connect the common terminal and the third terminal, the signals can be output.

17 Claims, 12 Drawing Sheets

MULTI-INSTRUCTION SWITCH

FIELD OF THE INVENTION

The present invention relates to a switch and particularly to a multi-instruction switch with rotation instructions and pressing instructions.

BACKGROUND OF THE INVENTION

Multi-instruction switch is widely used now in various information appliances (IAs) such as mobile phones, PDAs, computer keyboards and the like. The multi-instruction switch can provide electric connection in multiple stages and generate a plurality circuit signals, hence a single switch can execute multiple actions to reduce the size of the information products. Utilization also is more convenient.

U.S. Pat. Nos. 6,236,002 B1 and 6,262,378 B1 disclose a rotary switch which includes a rotary dial, a binding member to hold the rotary dial, a rotary plate located in the binding member and coupled with the rotary dial to be driven thereof, and a housing coupled with the binding member. The housing has a common terminal and a first contact and a second contact that contain a plurality of connecting terminals. A plurality of depressing members are located on the coupling surface between the rotary plate and the housing corresponding to the second contact to generate a plurality of different circuit signals. When the rotary dial receives a force and drives the rotary plate to rotate, the depressing members compress the second contact to generate different signals. A pressing element is provided to compress the first contact to form a passage to output the circuit signals.

The aforesaid rotary switch provides a two-stage design to improve the shortcoming of the conventional one stage design which rotates and immediately outputs a circuit signal. But it has to provide a plurality of depressing members on the lower side of the rotary plate to generate multiple circuit signals. The size of the rotary switch is greater. The product adopted such a rotary switch cannot be shrunk as desired. Moreover, it consists of too many elements. Fabrication and assembly are more difficult, and production cost is higher.

SUMMARY OF THE INVENTION

Therefore the primary object of the present invention is to provide a multi-instruction switch that can generate a plurality of circuit signals.

To achieve the foregoing object, the multi-instruction switch according to the invention includes a control disk, an anchor member and a depressing element. The control disk can drive a first conductive element to rotate relative to the anchor member. The anchor member has a terminal connector which includes a common terminal, a first terminal, at least one second terminal and a third terminal. There is a second conductive element located beneath the depressing element that can move up and down relative to the depressing element to connect a circuit. The first conductive element has a plurality of contact arms mating the terminal connector. One of the contact arms is connected to the common terminal in normal conditions. Other contact arms are connected alternately to contact zones and non-contact zones of the first and second terminals to generate a plurality of signals. By pressing the depressing element to connect the common terminal and the third terminal, the signals can be output. Thus one signal switch can execute a plurality of actions. The structure is compact and simple.

According to another embodiment of the invention, an accurate positioning adjustment design is provided. There is an anchor bar located beneath the control disk that has a bent portion in the middle section. The anchor member has guiding notches on the perimeter corresponding to the bent portion. By rotating the control disk according to preset marks formed thereon, anchoring position can be accurately adjusted and set to issue correct commands. It also provides an improved click feeling.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
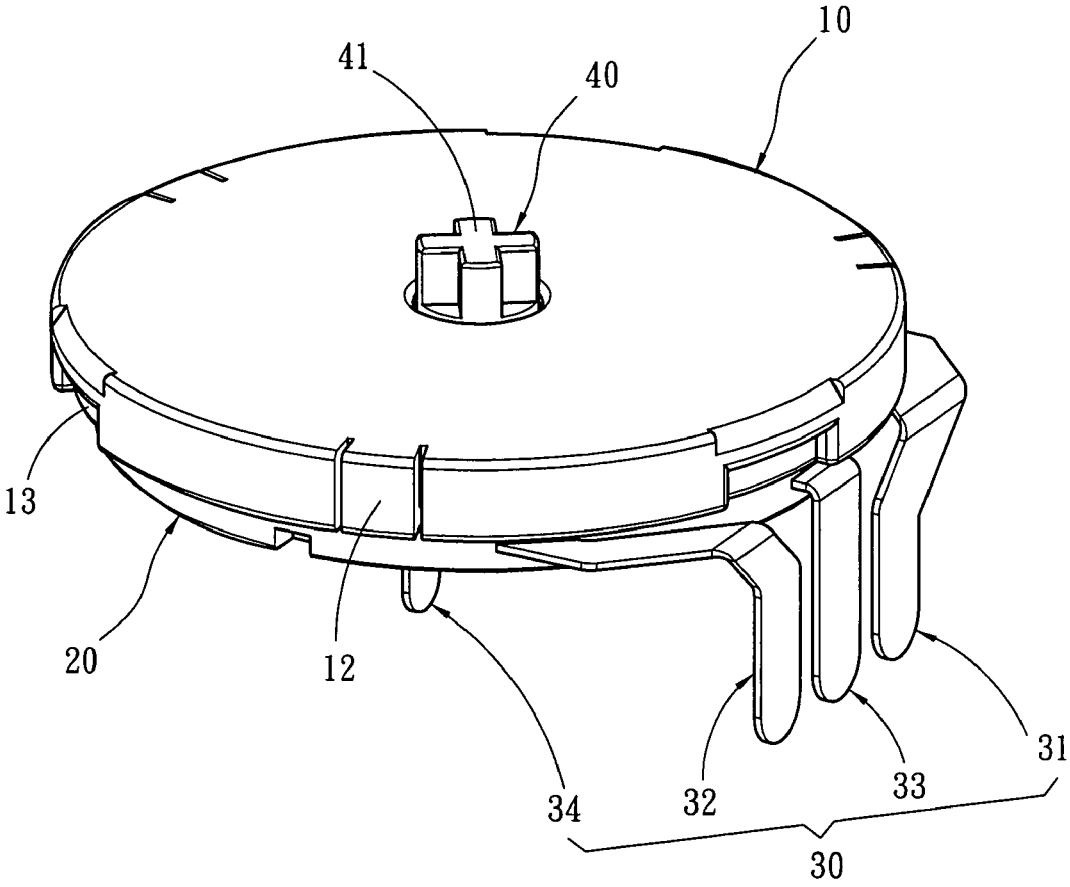
FIG. 1 is a perspective view of an embodiment of the multi-instruction switch of the present invention.
Figure 2:
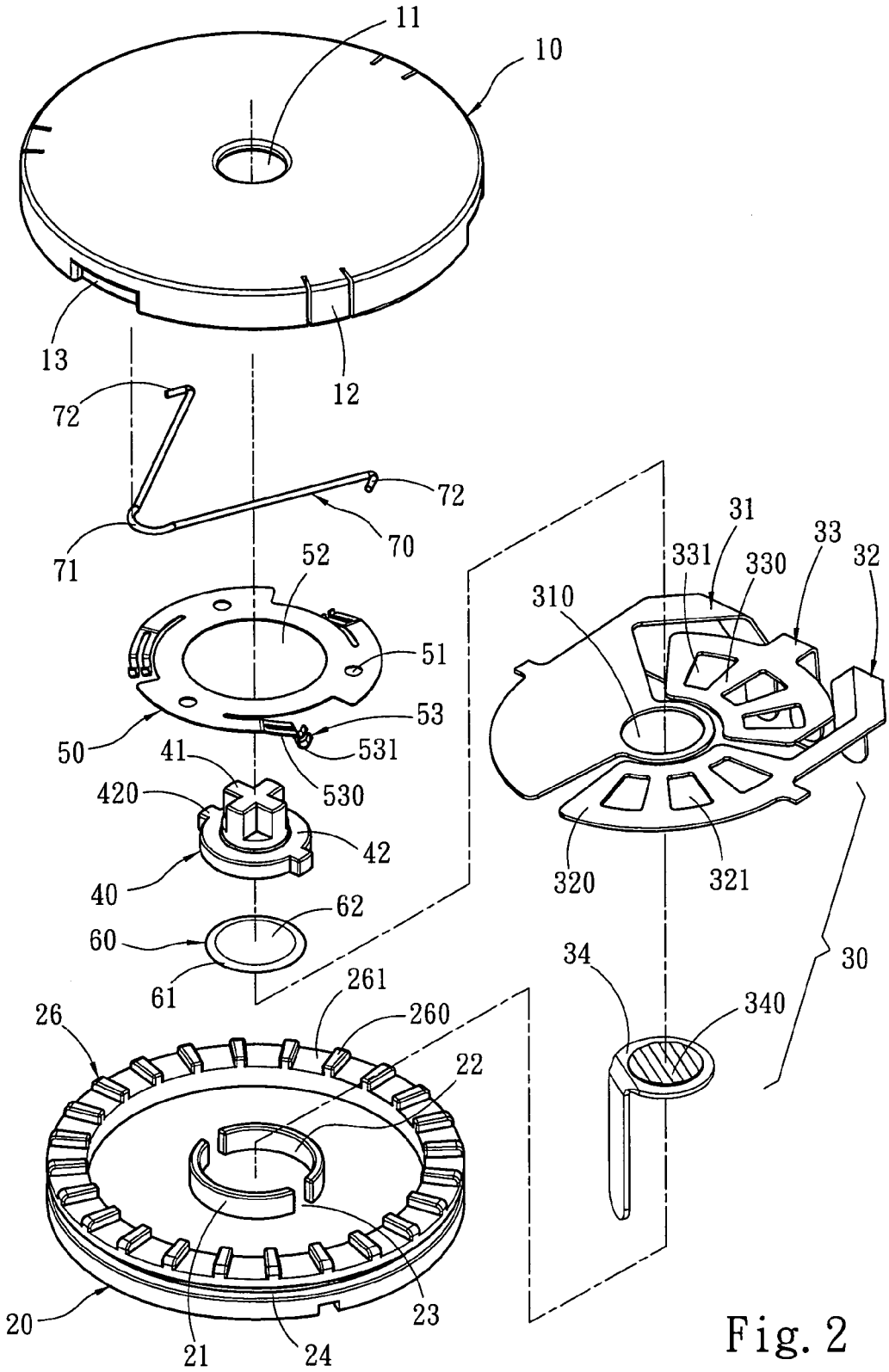
FIGS. 2 through 4 are exploded views of an embodiment of the multi-instruction switch.
Figure 3:
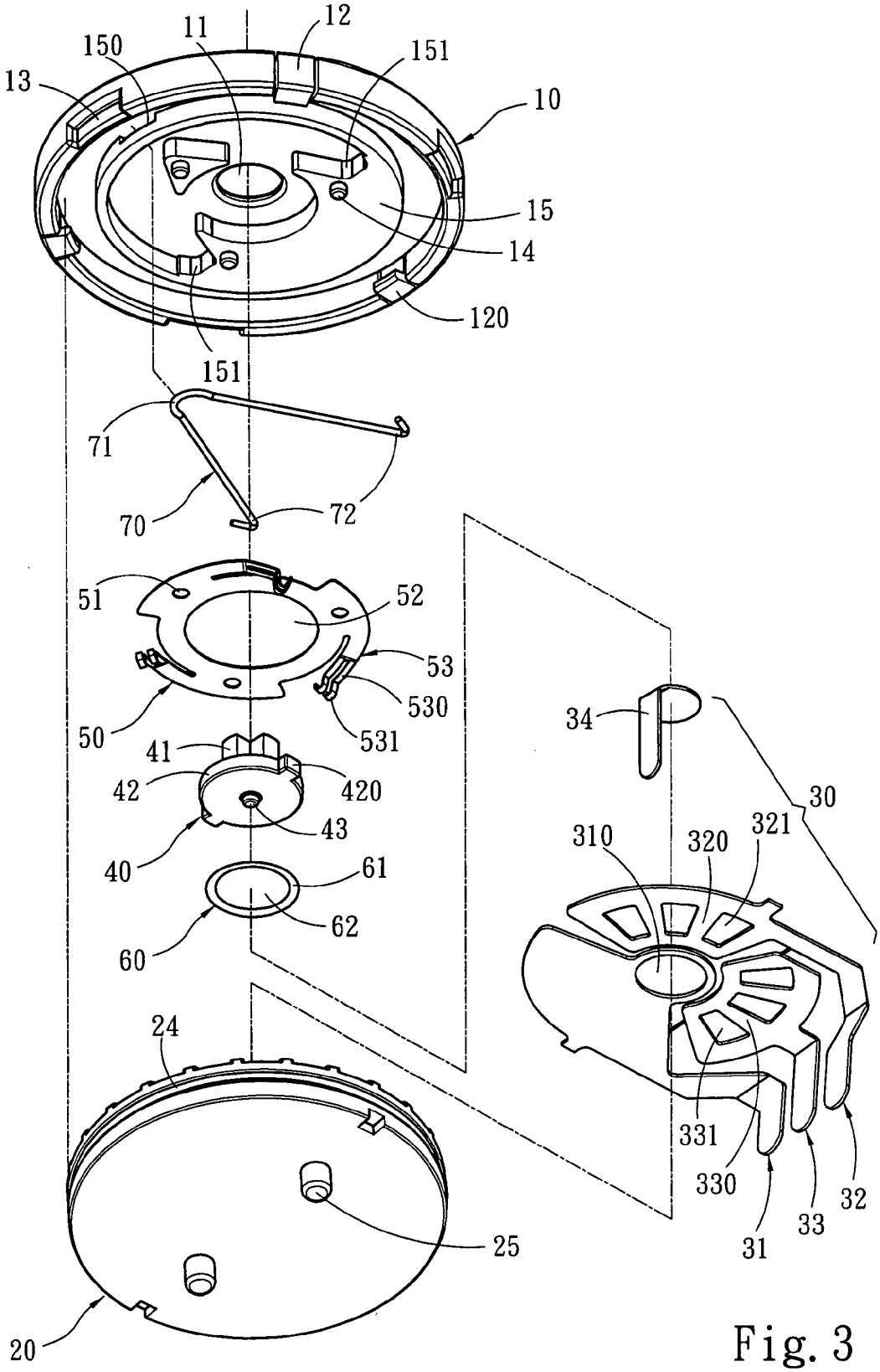

Please refer to FIGS. 1, 2 and 3 for an embodiment of the multi-instruction switch of the invention. It includes a control disk 10, an anchor member 20 which contains a terminal connector 30 and a depressing element 40.

The control disk 10 has an opening 11 on an upper side to hold the depressing element 40, a plurality of coupling portions 12 on the perimeter that are movable. Each of the coupling portions 12 has a retaining portion 120 for coupling the control disk 10 on an upper side of the anchor member 20. The perimeter of the control disk 10 further has a plurality of recesses 13 for coupling with external elements.

The anchor member 20 has a protrusive detent portion 21 in the center which has an anchor trough 22 and two notches 23 on two sides of the anchor trough 22. The depressing element 40 and a second conductive element 60 are held and anchored in the anchor trough 22. The anchor member 20 further has an annular groove 24 on the perimeter to couple with the retaining portion 120 so that the annular groove 24 serves as a track to allow the retaining portion 120 to slide therein thereby the control disk 10 can rotate relative to the anchor member 20. Moreover, the anchor member 20 has a plurality of jutting fastening portions 25 to allow the multi-instruction switch to be installed on a desired product such as a telephone, keyboard, PDA or the like.

Figure 4:
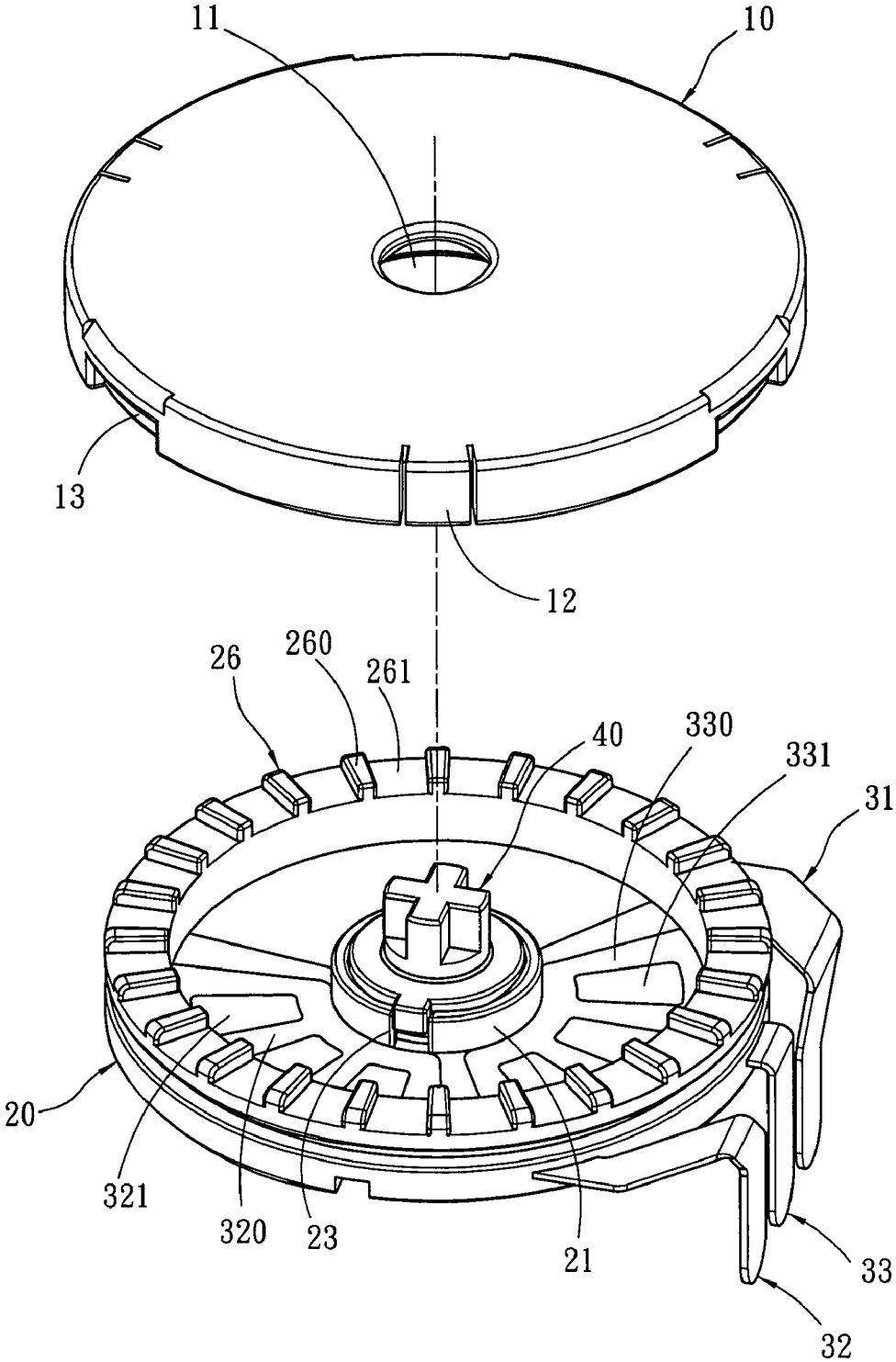

The anchor member 20 contains the terminal connector 30. The terminal connector 30 includes a common terminal 31, a first terminal 32, a second terminal 33 and a third terminal 34. Referring to FIG. 4, the common terminal 31, first terminal 32, second terminal 33 and third terminal 34 are embedded in the anchor member 20 by injection forming to become an integrated body. The common terminal 31 has a hole 310 in the center. In this embodiment, the first terminal 32 has at least one contact zone 320 and one non-contact zone 321 that are spaced from one another. The first non-contact zone 321 is a carved out opening. The second terminal 33 is constructed like the first terminal 32, and has at least one second contact zone 330 and one second non-contact zone 331. There is a first conductive element 50 which is connected to the common terminal 31 in normal conditions, and can be connected alternately to the first terminal 32 and second terminal 33 to switch signals. Operation details will be discussed later. The number of the first contact zone 320, the first non-contact zone 321, the second contact zone 330, and the second non-contact zone 331 is not limited to what have been shown in the drawings. The third terminal 34 has a connecting portion 340 to be connected to a circuit.

The depressing element 40 includes a depressing portion 41, a bottom seat 42 and a bulged spot 43. The depressing portion 41 is extended through the opening 11 of the control disk 10 to be depressed by users. The bottom seat 42 has two lugs 420 extended from two ends. The bulged spot 43 is located on a lower side of the bottom seat 42 to press the second conductive element 60. Place the second conductive element 60 and the depressing element 40 in the anchor trough 22 in this order, the bottom seat 42 is wedged in the anchor trough 22 and the two lugs 420 are wedged in the notches 23, thereby the depressing element 40 can be anchored on the anchor member 20.

In this embodiment, the first conductive element 50 and the second conductive element 60 are connected to the terminal connector 30 to form a circuit connection. The first conductive element 50 is a circular disk which has a plurality of fastening holes 51 to be fastened by a plurality of fastening struts 14 formed on the bottom side of the control disk 10. Rotating the control disk 10, the first conductive element 50 is driven and rotated synchronously. The first conductive element 50 further has an aperture 52 in the center with an inner diameter slightly larger than the outer diameter of the anchor trough 22. Thereby when the control disk 10 drives the first conductive element 50 to rotate, the first conductive element 50 does not have friction with the anchor trough 22 and the depressing element 40, thus the elements are less likely to wear off. In this embodiment, the first conductive element 50 has three contact arms 53 extended from the periphery. Each of the contact arms 53 has an elastic pressing portion 530 and a contact portion 531. The elastic pressing portion 530 provides elasticity to the contact arm 53. The contact portion 531 can be in contact with the common terminal 31, first terminal 32 and second terminal 33. The contact arm 53 has a downward elastic return force when subject to compression to provide a desired connection.

In this embodiment, the number and location of the contact arms 53 of the first conductive element 50 mate the total number and locations of the common terminal 31, first terminal 32 and second terminal 33. One of the contact arms 53 is connected to the common terminal 31 in the normal conditions. Two other second contact arms 53 are connected alternately to the first terminal 32 and second terminal 33 through the first contact zone 320, first non-contact zone 321, second contact zone 330 and second non-contact zone 331. Thereby multiple circuit signals can be generated. The number of the contact arms 53 should mate the total number of the common terminal 31, first terminal 32 and second terminal 33. The drawings serve only illustrative purpose, and are not the limitation of the invention. Multiple second terminals 33 and contact arms 53 may also be formed to generate multiple circuit signals, namely to contain multiple function keys that can generate different instructions.

The second conductive element 60 can be moved up and down relative to the depressing element 40. It is a dome-shaped elastic blade, and includes a flat portion 61 on the periphery and a convex portion 62 in the center. The flat portion 61 is connected to the common terminal 31 in the normal conditions. The convex portion 62 is connected to the third terminal 34. When the depressing element 40 is depressed downwards, the bulged spot 43 compresses the convex portion 62 which in turn compresses the third terminal 34 on the lower side so that the common terminal 31 and the third terminal 34 form an electric connection to issue a signal output. Instead of the dome-shaped elastic blade, the second conductive element 60 may also be formed in other shapes as long as it can receive the compression of the bulged spot 43 to connect the common terminal 31 and the third terminal 34 to form the electric connection.

In another aspect, the embodiment can also include a design to provide an accurate adjustment and positioning. Referring to FIGS. 2, 3 and 4, the control disk 10 further has an anchor portion 15 on a lower side to anchor an anchor bar 70. The anchor portion 15 includes a through hole 150 and two latch portions 151. The anchor bar 70 is bent in V-shape with a bent portion 71 in the middle and two latch sections 72 on two ends. The bent portion 71 runs through the through hole 150 and is extended outside thereof. The two latch sections 72 are latched on the latch portions 151 to anchor the anchor bar 70. The anchor member 20 has a guiding portion 26 on the periphery corresponding to the circumference of the bent portion 71. The guiding portion 26 has a plurality of radial and spaced guiding ridges 260 and a plurality of guiding notches 261 formed between them. In general conditions, the bent portion 71 is held in the guiding notch 261. When the control disk 10 is rotated, the anchor bar 70 located thereunder is driven to rotated at the same time. The bent portion 71 switches the position in the guiding notches 261. When the bent portion slides over the guiding ridges 260, a click sound is generated. Hence users can sense the click during rotation. Mating the marks on the upper side of the control disk 10, users can issue correct instructions with few errors.

Figure 5A:
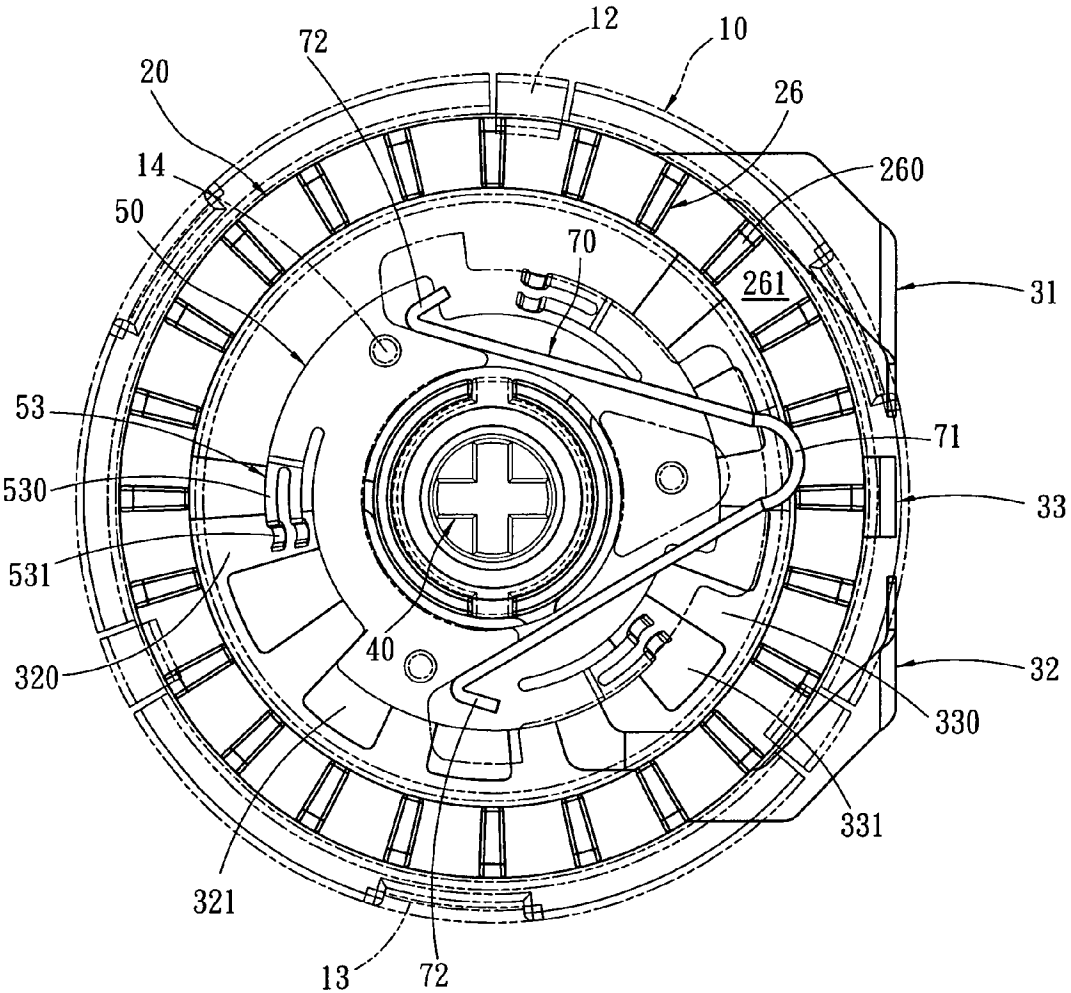
FIGS. 5A and 5B are schematic views of an embodiment of the multi-instruction switch in rotating conditions.
Figure 5B:
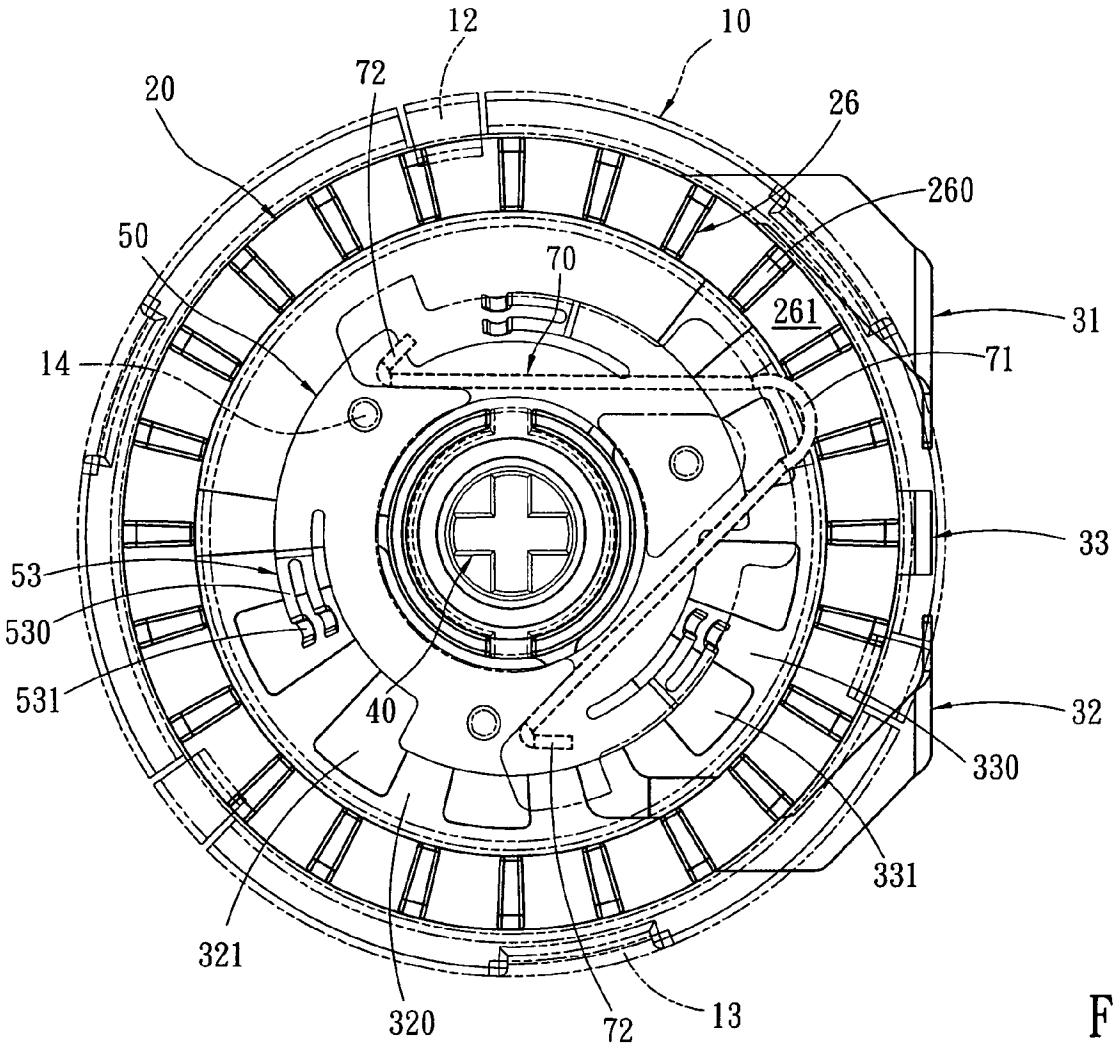

When the embodiment is in use, referring to FIGS. 5A and 5B, the user grasps the recesses 13 of the control disk 10 to rotate the control disk 10 and switch instructions. The bent portion 71 of the anchor bar 70 is moved to a desired guiding notch 261 corresponding to a selected mark on the control disk 10 to issue a correct instruction. Adjustment and anchoring can be done easily. The click feeling also is enhanced. One of the contact arms 53 of the first conductive element 50 is connected to the common terminal 31. The other two contact arms 53 are connected to either the first terminal 32 or second terminal 33. As shown in FIG. 5A, one contact arm 53 is connected to the first contact zone 320 of the first terminal 32, and another contact arm 53 is located on the second non-contact zone 331 without connecting to the second terminal 33. In FIG. 5B, the control disk 10 is switched to have one contact arm 53 on the first non-contact zone 321 without connecting to the first terminal 32, while another contact arm 53 being connected to the second contact zone 330 of the second terminal 33. Therefore a switch signal is generated.

Figure 6A:
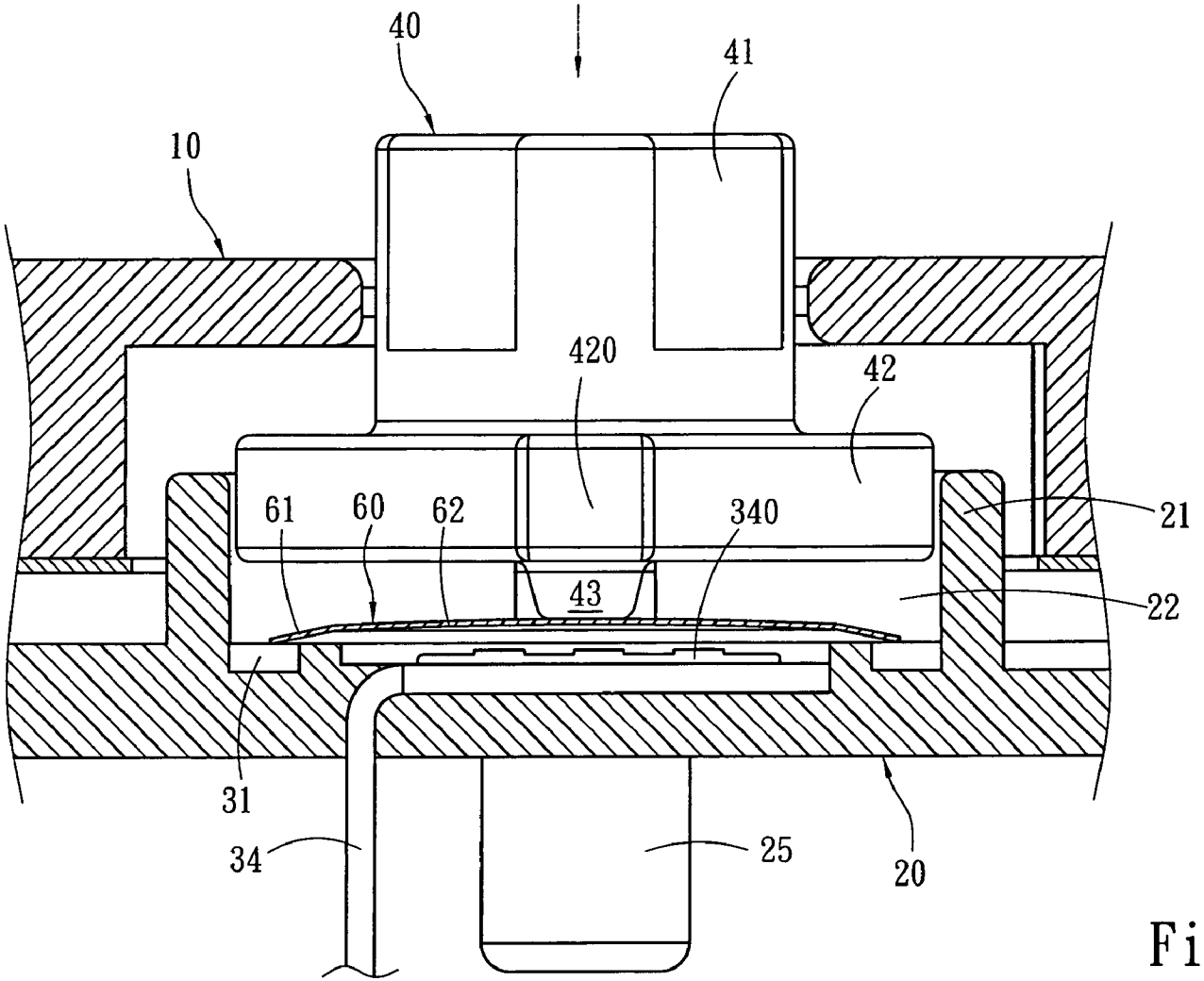
FIGS. 6A and 6B are schematic views of an embodiment of the multi-instruction switch in depressing conditions.
Figure 6B:
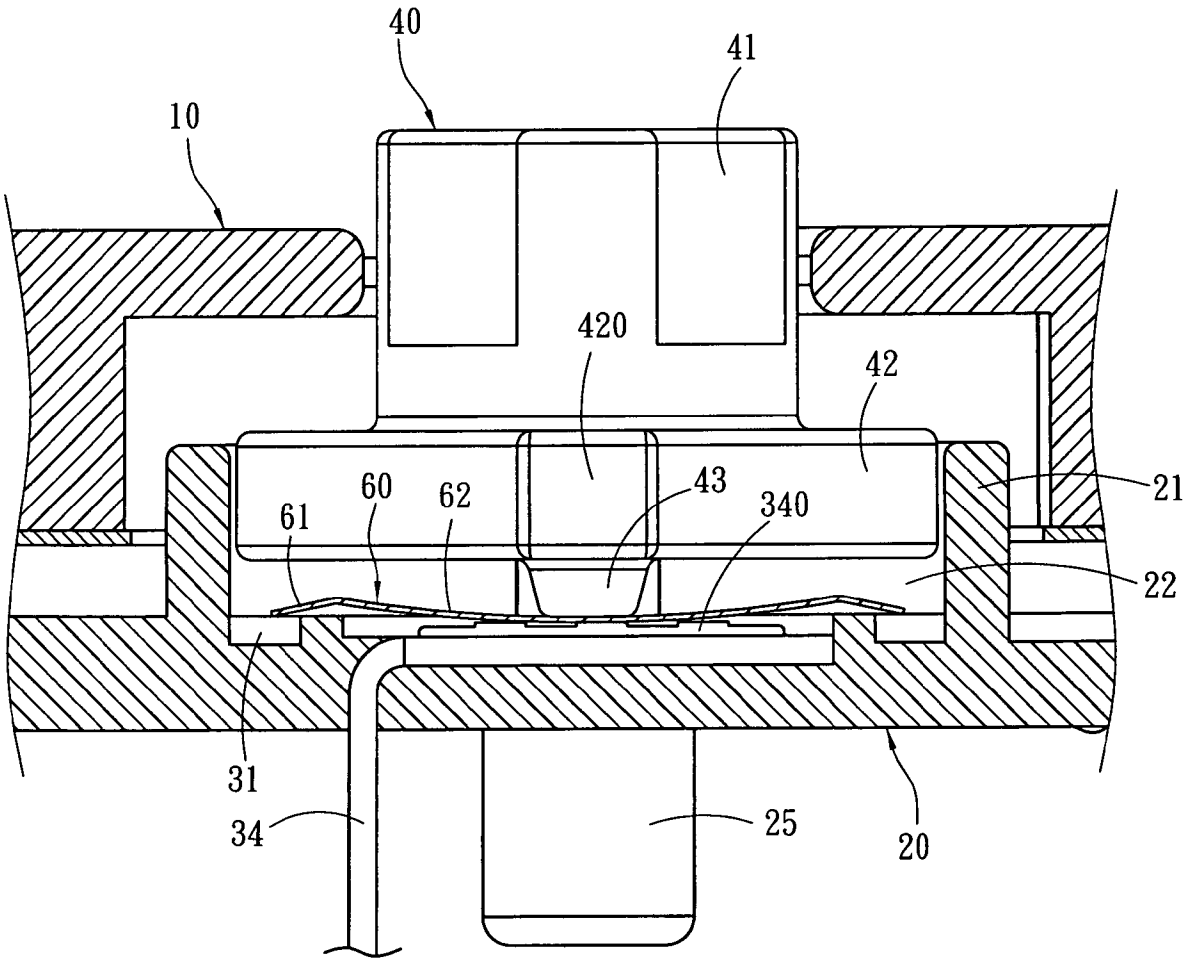

Referring to FIGS. 6A and 6B, as the second conductive element 60 is elastic, when the convex portion 62 of the second conductive element 60 is in contact with the bulged spot 43 of the depressing element 40 on the upper side, the flat portion 61 of the second conductive element 60 is connected to the common terminal 31. But the common terminal 31 is not connected to the third terminal 34, hence no signal is output (referring to FIG. 6A). When the control disk 10 is rotated to a position where an instruction is to be issued, depress the depressing element 40, the bulged spot 43 compresses the convex portion 62 of the second conductive element 60, the convex portion 62 is connected to the connecting portion 340 of the third terminal 34, hence the common terminal 31 and the third terminal 34 form a connection passage to issue the desired signal output (referring to FIG. 6B). As the second conductive element 60 is elastic, when the depressing element 40 is released, the convex portion 62 rebounds upwards, and the common terminal 31 and the third terminal 34 are not connected again, therefore signal output is stopped.

In this embodiment, the combination of the contact arms 53 of the first conductive element 50 and the common terminal 31, first terminal 32 and second terminal 33 of the terminal connector 30 is used to replace the conventional multi-instruction switch that is complex and bulky. It also provides encoding function and can generate different circuit signals. In addition, with one contact arm 53 of the first conductive element 50 connecting to the common terminal 31 in the normal conditions, and the other two contact arms 53 connecting alternately with the first terminal 32 and second terminal 33, two different circuit signals can be generated. In another embodiment of the invention, a plurality of second terminals 33 may be formed. Mating the additional contact arms 53 of the first conductive element 50, more signal combinations can be formed. This serves only for illustrative purpose, and is not the limitation of the invention.

Figure 7:
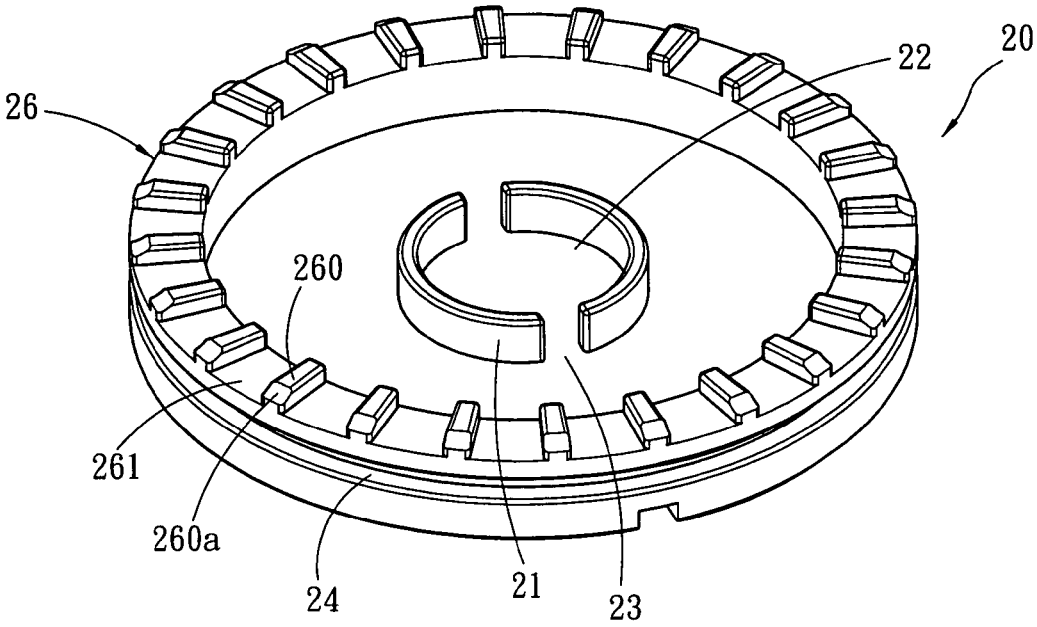
FIG. 7 is a schematic view of another embodiment of the anchor member of the multi-instruction switch.

In yet another embodiment of the invention, the edge of each guiding ridge 260 may have a chamfered angle 260*a* as shown in FIG. 7. Therefore, when the control disk 10 is rotated on the anchor member 20, friction between the control disk 10 and the anchor member 20 can be reduced to make rotation smoother, and wearing of elements also can be reduced.

Figure 8:
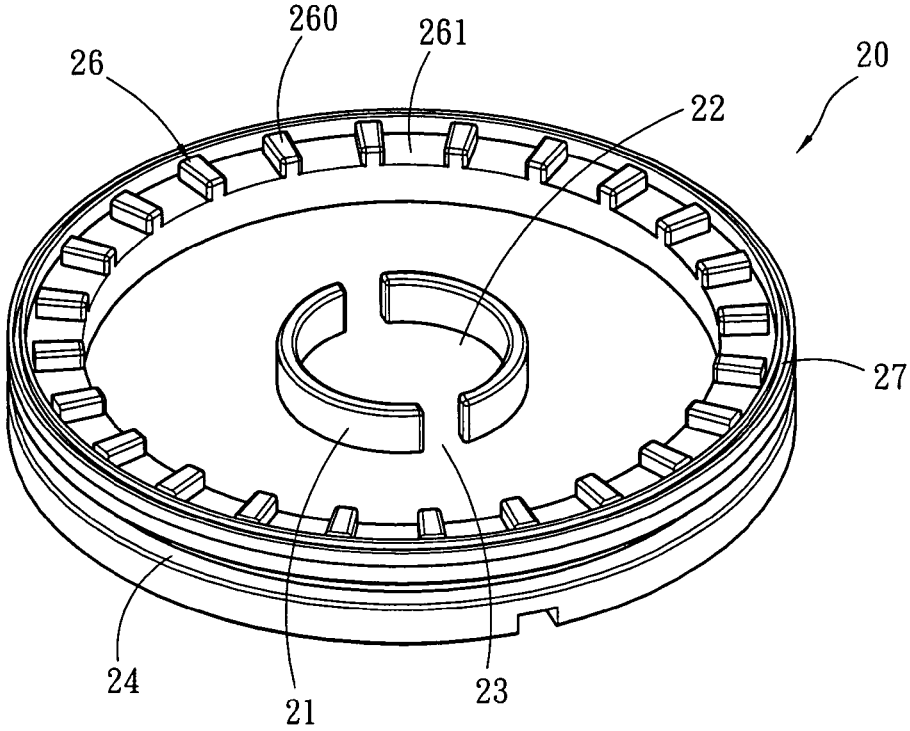
FIG. 8 is a schematic view of yet another embodiment of the anchor member of the multi-instruction switch.
Figure 9:
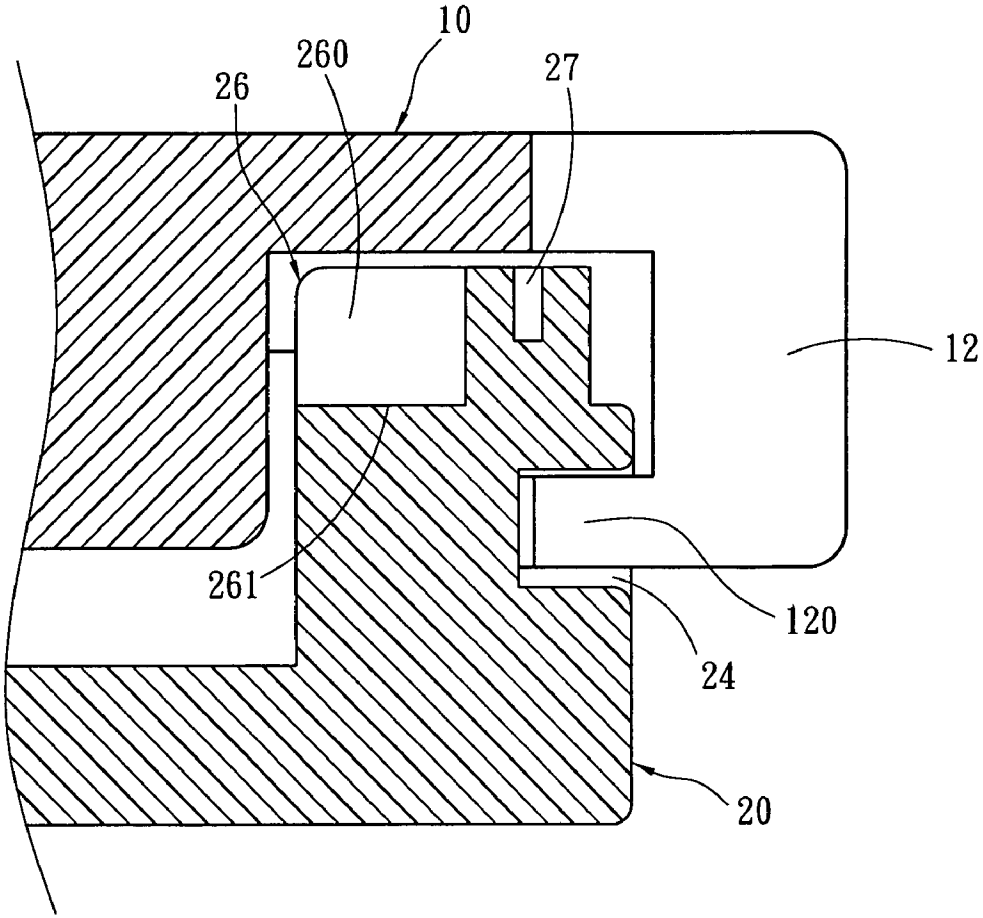
FIG. 9 is a fragmentary sectional view of another embodiment according to FIG. 8 with the control disk and the anchor member in a coupled condition.

Refer to FIGS. 8 and 9 for another embodiment of the invention. The guiding portion 26 of the anchor member 20 has an annular ditch 27 to contain lube oil (not shown in the drawings). Therefore, the control disk 10 can be rotated on the anchor member 20 smoother.

Figure 10:
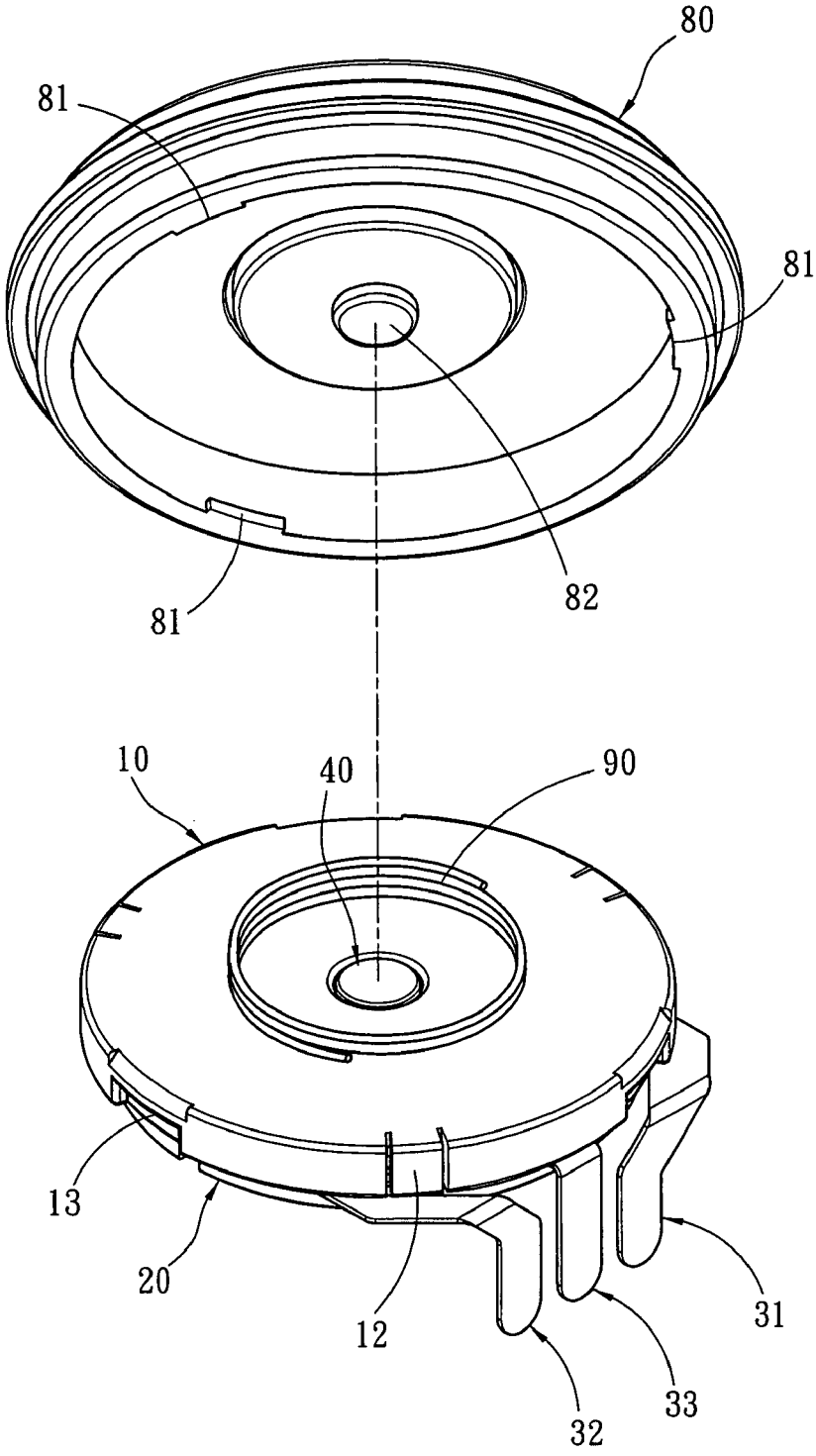
FIG. 10 is a schematic view of another embodiment of the multi-instruction switch.

Refer to FIG. 10 for yet another embodiment of the invention. The control disk 10 is encased by a cap 80. The cap 80 has a plurality of coupling members 81 to latch on the recesses 13 of the control disk 10. Hence the cap can drive the control disk 10 to rotate. The cap 80 further has a bulged portion 82 in the center of the bottom thereof mating the depressing element 40. When the cap 80 encases the control disk 10, an elastic element 90 is interposed between the cap 80 and the control disk 10. When in use, users can directly rotate the cap 80 to drive the control disk 10, and can depress any spot of the control disk 10 when a desired location is arrived to issue an instruction. The elastic element 90 is compressed and generates an upward returning elastic force. The bulged portion 82 is depressed to compress the depressing element 40 to output the signal. When the depression on the cap 80 is released, the elastic element 90 is rebounded to return the control disk 10 to its original position to latch on the control disk 10.

Figure 11:
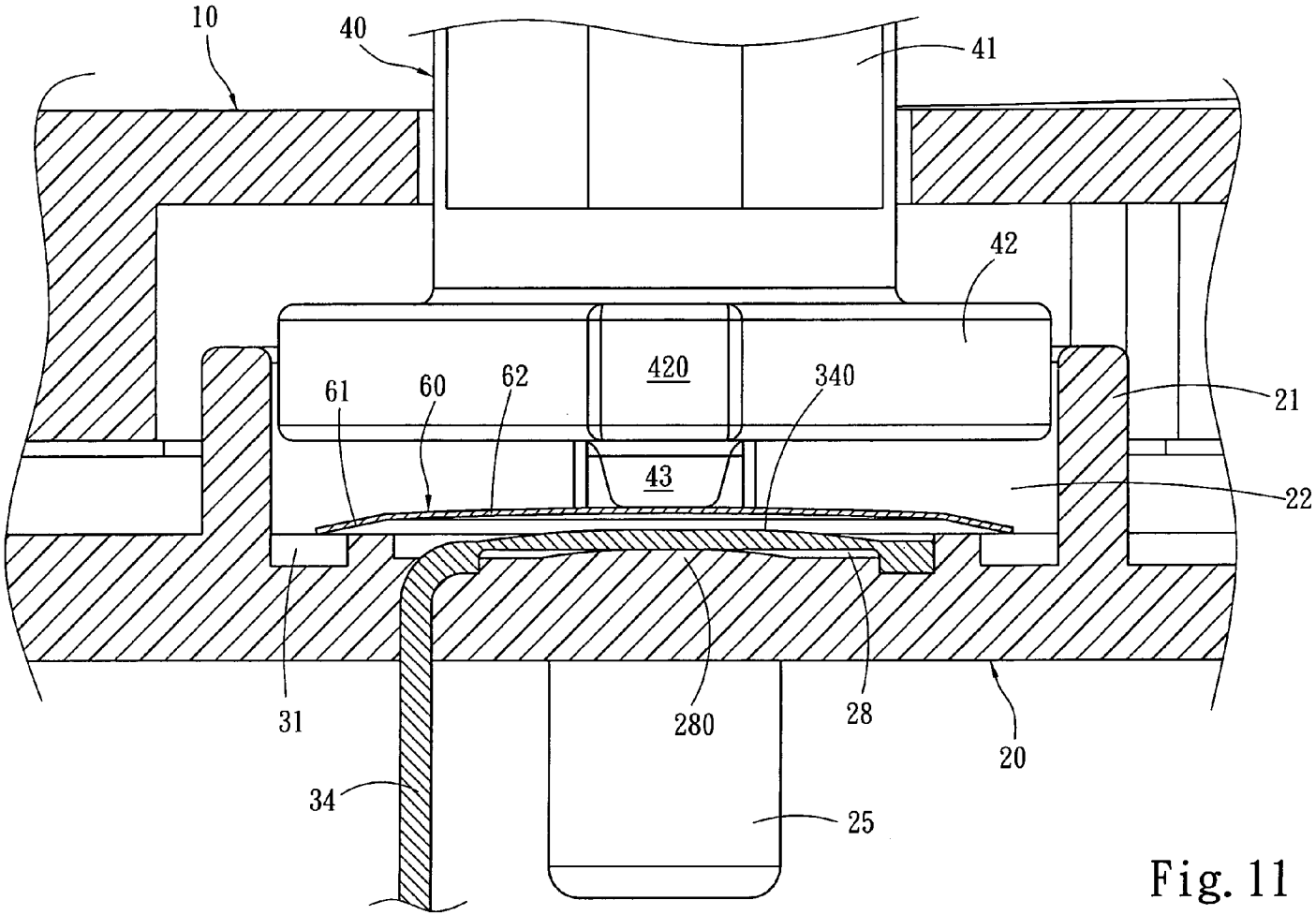
FIG. 11 is a sectional view of another embodiment of the multi-instruction switch.

Referring to FIG. 11, while the third terminal 34 is embedded with the common terminal 31, first terminal 32 and second terminal 33 by injection forming to become an integrated body with the anchor member 20 in the previous embodiments, in this embodiment the third terminal 34 is inserted into the anchor member 20 to reduce the interference of circuit layout of the common terminal 31, first terminal 32 and second terminal 33. To achieve this object, the anchor member 20 has a housing space 28 mating the shape of the third terminal 34. The housing space 28 has a detent boss 280 to confine the third terminal 34 from moving.

In summary, the multi-instruction switch of the invention includes a first conductive element 50 which has plurality of contact arms 53 and a terminal connector 30 which has a plurality of terminals that are coupled together. When in use and rotated, multiple different circuit signals can be generated so that a plurality of different instructions are output. The structure is compact and fabrication is simpler. Production time and cost also can be reduced.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A multi-instruction switch, comprising:

a control disk having an opening on an upper side and a first conductive element located on a lower side that is rotated synchronously with the control disk;

an anchor member which rotates relative to the control disk and has an anchor trough in the center and a terminal connector, the terminal connector including a common terminal, a first terminal, at least one second terminal and a third terminal, the first terminal and the second terminal having respectively at least one contact zone and one non-contact zone, the first conductive element being connected to the common terminal in normal conditions, and connected alternately to the contact zone and non-contact zone of the first terminal and the second terminal to generate a plurality of instruction signals; and a depressing element which corresponds to the opening and the anchor trough, and includes a second conductive element on a lower side, and is movable up and down relative to the anchor member and the control disk so that the second conductive element is connected to the common terminal in the normal conditions, the second conductive element being connected to the third terminal through compression of the depressing element to generate another instruction signal.

2. The multi-instruction switch of claim 1, wherein the control disk has a plurality of coupling portions on the periphery each having a protrusive retaining portion in the direction of the opening, the anchor member having an annular groove on the perimeter to be coupled with the retaining portion, the annular groove serving as a track to allow the control disk to be rotated relative to the anchor member.

3. The multi-instruction switch of claim 1, wherein the control disk has a plurality of recesses on the perimeter to couple with external elements.

4. The multi-instruction switch of claim 3, wherein the control disk is encased by a cap which has a plurality of coupling members on the periphery to be coupled with the recesses of the control disk so that the control disk is driven by the cap to rotate, the cap having a bulged portion in the center of the bottom thereof, the cap and the control disk being interposed by an elastic element, the cap being depressible to compress the elastic element, the depressing element being depressible by the bulged portion.

5. The multi-instruction switch of claim 1, wherein the depressing element has a depressing portion extended outside the opening and a bottom seat located in the anchor trough.

6. The multi-instruction switch of claim 5, wherein the anchor trough has two notches on two sides, the bottom seat having two lugs on two ends wedging in the notches to anchor the depressing element.

7. The multi-instruction switch of claim 5, wherein the bottom seat has a bulged spot on a lower side thereof to press the second conductive element.

8. The multi-instruction switch of claim 1, wherein the anchor member has a plurality of protrusive fastening members on the bottom surface.

9. The multi-instruction switch of claim 1, wherein the first conductive element has a plurality of fastening holes, and the control disk has a plurality of fastening struts on the bottom surface to couple with the fastening holes.

10. The multi-instruction switch of claim 1, wherein the first conductive element has an aperture in the center which has an inner diameter greater than the outer diameter of the anchor trough.

11. The multi-instruction switch of claim 1, wherein the first conductive element has a plurality of contact arms extended from the periphery, the contact arms being connected to the common terminal, the first terminal and the second terminal.

12. The multi-instruction switch of claim 11, wherein each of the contact arms has an elastic pressing portion and a contact portion.

13. The multi-instruction switch of claim 1, wherein the second conductive element is a circular dome-shaped blade and includes a peripheral flat portion and a convex portion in the center, the flat portion being connected to the common terminal in the normal conditions, the convex portion being connected to the third terminal.

14. The multi-instruction switch of claim 1, wherein the control disk has an anchor portion on a lower side to anchor an anchor bar, the anchor bar having a bent portion in the middle and two latch sections on two ends, the anchor member having a guiding portion on the periphery corresponding to the circumference of the bent portion, the guiding portion having a plurality of radial guiding ridges and a plurality of guiding notches former between the guiding ridges, the bent portion being switchable in the guiding notches when the control disk rotates.

15. The multi-instruction switch of claim 14, wherein the anchor portion has a through hole and two latch portions, the bent portion running through the through hole and being extended outside thereof, the latch portions being coupled with the latch sections.

16. The multi-instruction switch of claim 14, wherein each of the guiding ridges has a chamfered angle.

17. The multi-instruction switch of claim 14, wherein the guiding portion has an annular ditch on the periphery to contain lube oil.

* * * * *